US009186785B2

(12) United States Patent
Hung

(10) Patent No.: US 9,186,785 B2
(45) **Date of Patent: *Nov. 17, 2015**

(54) BEARING ADJUSTER

(71) Applicant: Cheng-Hao Hung, Tainan (TW)

(72) Inventor: Cheng-Hao Hung, Tainan (TW)

( * ) Notice: Subject to any disclaimer, the term of this patent is extended or adjusted under 35 U.S.C. 154(b) by 388 days.

This patent is subject to a terminal disclaimer.

(21) Appl. No.: 13/742,373

(22) Filed: Jan. 16, 2013

(65) Prior Publication Data

US 2014/0196266 A1 Jul. 17, 2014

(51) Int. Cl.

| | |
|---|---|
| ***B25B 27/06*** | (2006.01) |
| *B25B 27/04* | (2006.01) |
| *B25B 27/02* | (2006.01) |

(52) U.S. Cl.

CPC ..... *B25B 27/06* (2013.01); *B25B 27/02* (2013.01); *B25B 27/04* (2013.01); *Y10T 29/5393* (2015.01)

(58) Field of Classification Search

USPC ..... 29/275

See application file for complete search history.

(56) References Cited

U.S. PATENT DOCUMENTS

| | | | | |
|---|---|---|---|---|
| 3,956,801 | A * | 5/1976 | Wood | 29/725 |
| 4,339,865 | A * | 7/1982 | Shultz | 29/525 |
| 4,429,447 | A * | 2/1984 | Davis | 29/275 |
| 5,528,809 | A * | 6/1996 | Green et al. | 29/275 |
| 6,088,898 | A * | 7/2000 | Lundsten | 29/255 |
| 7,644,481 | B2 * | 1/2010 | Kang | 29/271 |
| 7,707,709 | B2 * | 5/2010 | Whitehead | 29/724 |
| 2009/0302088 | A1 * | 12/2009 | Santamarina et al. | 227/139 |
| 2010/0162547 | A1 * | 7/2010 | Lai | 29/275 |

* cited by examiner

*Primary Examiner* — Christopher Harmon

(57) ABSTRACT

A bearing adjuster is comprised of a grip, an adjusting member, a fixing member and three movable members. The adjusting member is disposed on a protrusion of the grip. The fixing member is disposed on the adjusting member. The movable members are disposed on the fixing member correspondingly. A threaded rod of the grip is screwed in a threaded hole of a positioning protrusion of the fixing member. A sliding block of each movable member and positioning guide blocks of the sliding block are disposed in one of sliding grooves of the fixing member and positioning guide grooves of the sliding groove respectively. A guide protrusion of the movable member is disposed in one of corresponding grooves of the adjusting member. Thus, the bearing adjuster is able to adjust its' diameter to coordinate with different sizes of the bearings.

3 Claims, 9 Drawing Sheets

BEARING ADJUSTER

BACKGROUND OF THE INVENTION

1. Technical Field

The present invention relates to a bearing adjuster in particular able to adjust its' diameter as so to coordinate with bearings in different sizes so that the pounding force can be consistently distributed to the bearings when the bearings are impacted to install and which is very stable and convenient in use.

2. Description of Related Art

Generally, a bearing is mainly installed into a portion of an implement or an object and then the bearing is pounded by a hammer as so to push the bearing into the implement or object. However, the conventional way of installing the bearing has the shortcoming which the pounding force is applied inconsistently. That is all because the hammer pounds the bearing at different portions for multiple numbers of times and subjected to different pounding forces which will cause the imbalance installation of the bearing. In addition, a bearing adjuster set 7 capable of consistently distributing pounding forces is provided. As shown on FIG. 8 and FIG. 9, the bearing adjuster set 7 is provided with a grip 70 and at least one positioning press block 72 having a fixed diameter. A joint rod 71 is protruded at an end of the grip 70. The positioning press block 72 is joined with the grip 70, and is provided with a first abutting portion 720, a first hold-down edge 721, a second abutting portion 722 and a second hold-down edge 723. A joint piece 73 is joined with the grip 70. By abutting the abutting portion 720 or 722 and the hold-down edge 721 or 723 of the positioning press block 72 against an internal end edge and a top edge of an axle hole of the bearing, the force can be applied consistently while impacting on the bearing adjuster. Hence, the bearing can be assembled in position in a perforation of the implement or the object stably and rapidly. However, the positioning press block 72 of the prior art bearing adjuster set 7 is a fixed size. As a result, when a bearing is installed, a positioning press block 72 with an identical diameter to the bearing must be used so as to stably install the bearing. Therefore, when installing plural bearings in different sizes, the aforesaid bearing adjuster set must have positioning press blocks 72 with the identical diameters to the bearings in different sizes. This is much inconvenient in use. Moreover, if the aforesaid bearing adjuster set is used to install many bearings in different sizes, it is particularly inconvenient to prepare the necessary tools and replace the positioning press blocks 72 with different diameters.

BRIEF SUMMARY OF THE INVENTION

A primary objective of the present invention is to provide a bearing adjuster able to adjust its' diameter to coordinate with bearings in different sizes so that the pounding force can be consistently distributed to the bearings when the bearings are installed. Therefore, the bearing adjuster is very stable and convenient in use.

The bearing adjuster of the present invention is comprised of:

a grip having an end provided with a pounding portion and the other end provided with a protrusion, wherein a positioning annular groove is formed around the protrusion, and a threaded rod is disposed at a front end of the protrusion;

an adjusting member disposed on the protrusion of the grip wherein a connecting protrusion is disposed on a side of the adjusting member, a perforation is formed in the connecting protrusion, a positioning threaded hole is formed in a wall surface of the connecting protrusion to pass through the perforation, a positioning fastener is screwed in the positioning threaded hole of the adjusting member, an internal end of the positioning fastener abuts within the positioning annular groove of the grip, and three corresponding grooves in the form of an arc extending outwards from the center are bored on the outside of the perforation on the other side of the adjusting member, a fixing member disposed on the adjusting member wherein a positioning protrusion is disposed on a side of the fixing member, a joint threaded hole is formed in the positioning protrusion, the threaded rod of the grip is screwed in the joint threaded hole of the positioning protrusion, an annular groove is formed on an outer wall surface of the positioning protrusion, a washer is disposed on the annular groove, three sliding grooves are formed on the fixing member trisectionally, and positioning guide grooves opposite to each other are bored on both sides of the sliding grooves, and three movable members disposed on the fixing member correspondingly wherein a sliding block is disposed on a side of each of the three movable members, positioning guide blocks are protruded at two side edges of the sliding block, the sliding block is disposed in one of the sliding grooves of the fixing member, the positioning guide blocks are disposed in the positioning guide grooves of the sliding groove, a guide protrusion is disposed on surface of the sliding block and in one of the corresponding grooves of the adjusting member, the movable member is provided with a plurality of stepped abutting portions, and an external surface of the abutting portions is bored with an abutting edge.

Preferably, a washer is disposed on the threaded rod of the grip in order to help the grip to join with the fixing member more securely so as to prevent falling-off. The grip is bored with anti-slip pattern thereon, which can make it convenient for the user to hold the grip without falling-off. Two opposite planes are formed on the grip and can be clamped by an auxiliary tool. In addition, anti-slip pattern is provided around circumference of adjusting member, which can make it convenient for the user to grab the adjusting member without falling-off.

DETAILED DESCRIPTION OF THE INVENTION

Figure 1:
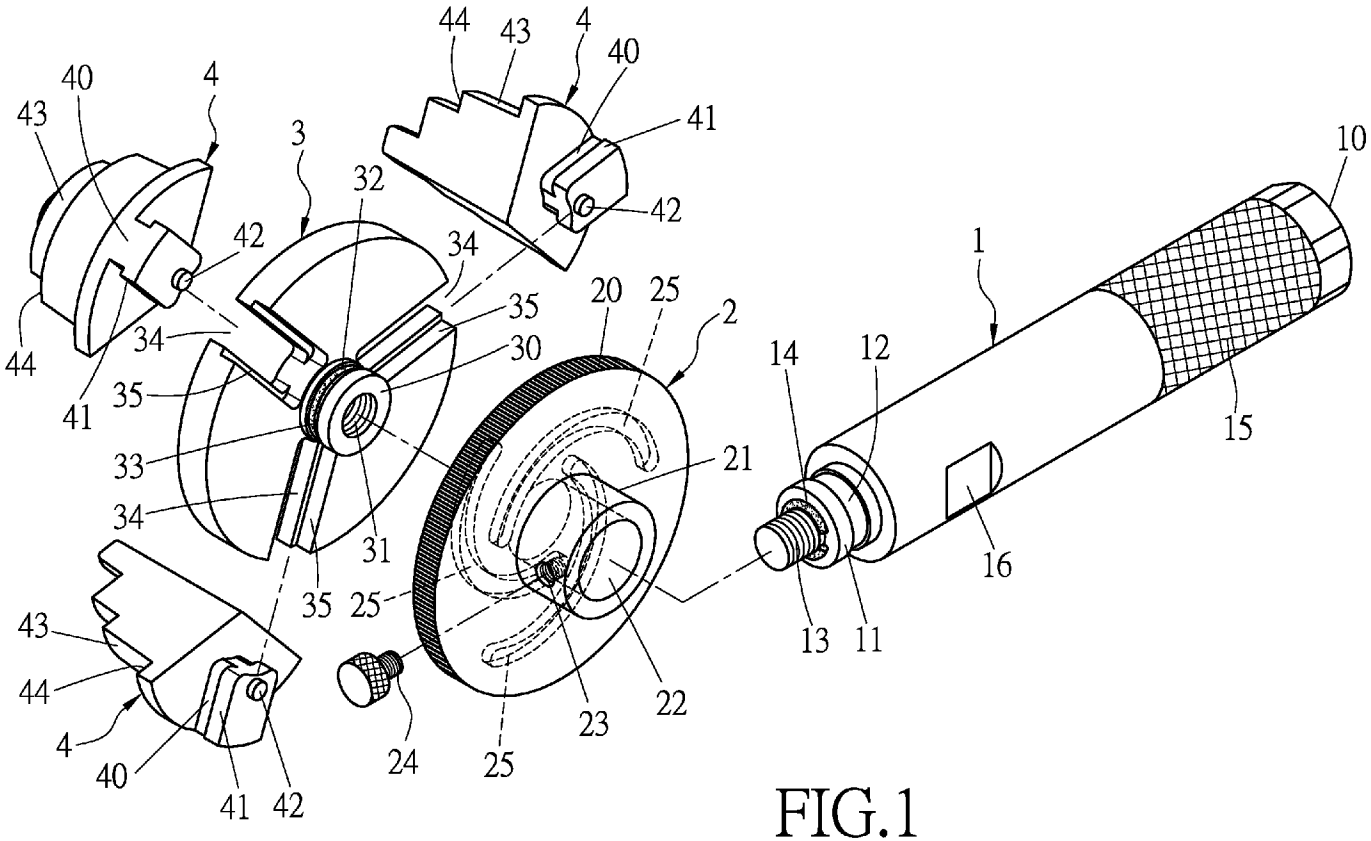
FIG. 1 is a perspective exploded view of an embodiment of the present invention.
Figure 2:
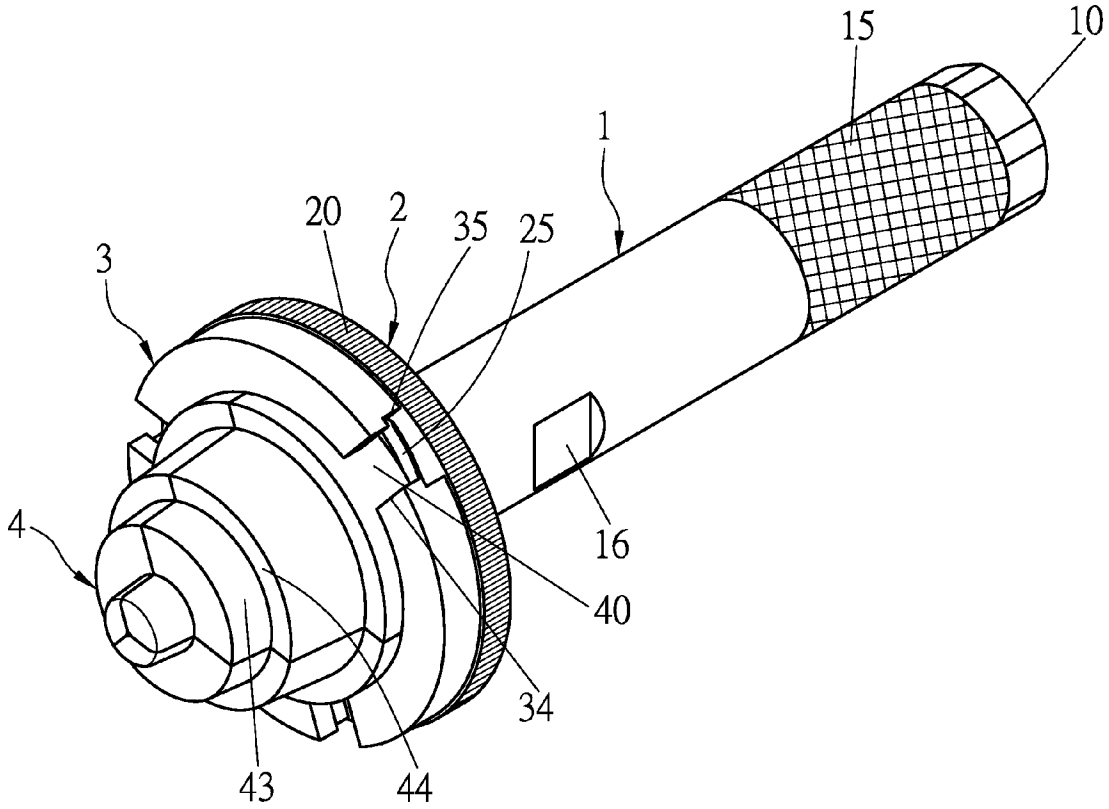
FIG. 2 is a perspective assembly view of the embodiment of the present invention.
Figure 3:
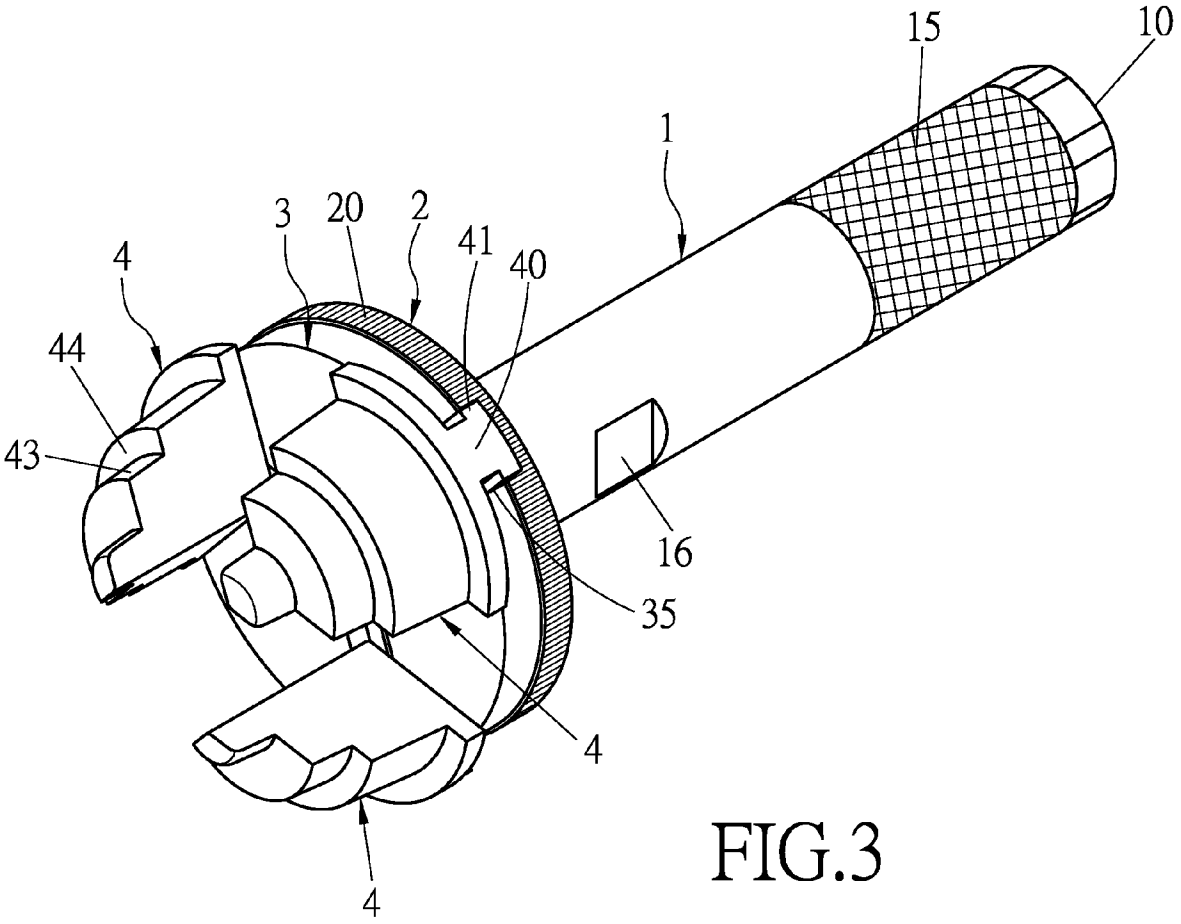
FIG. 3 is a schematic perspective view illustrating movable members according to the embodiment of the present invention when being moved outwards.
Figure 4:
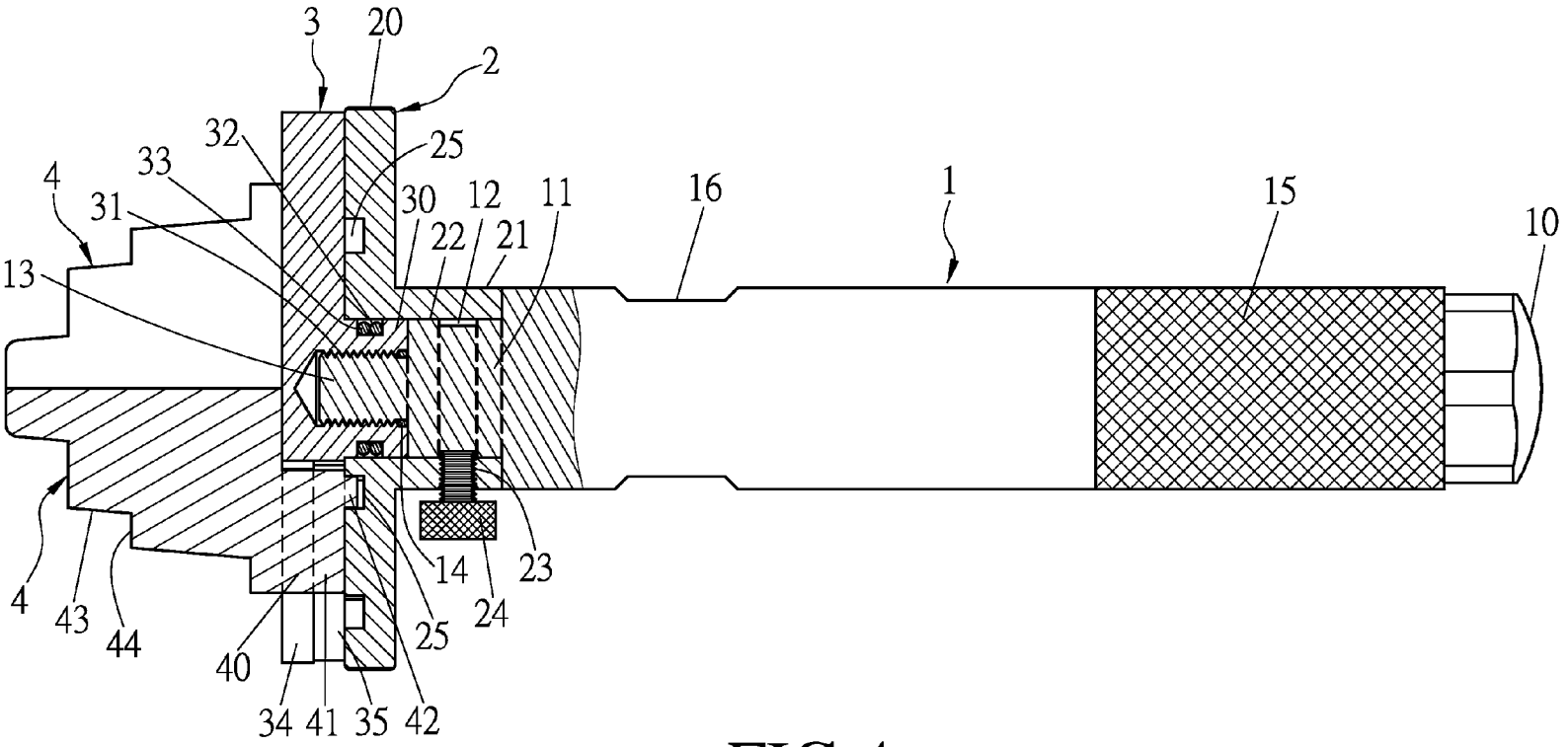
FIG. 4 is a cross-sectional assembly view of the embodiment of the present invention.
Figure 5:
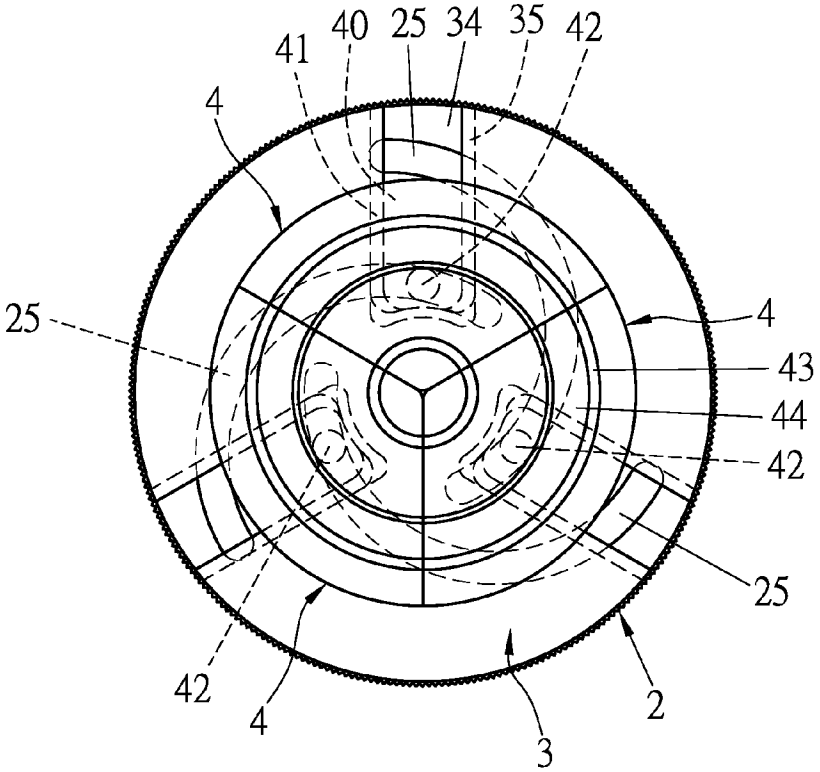
FIG. 5 is a schematic plan view illustrating the movable members according to the embodiment of the present invention when being closed.
Figure 6:
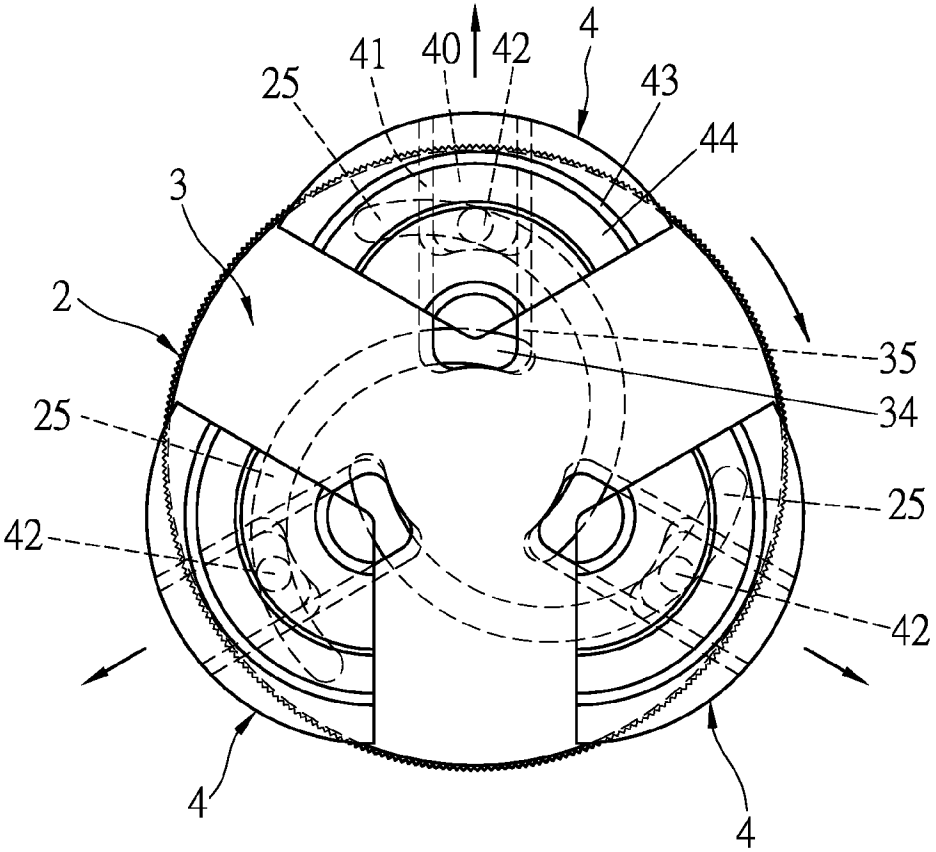
FIG. 6 is a schematic plan view illustrating the movable members according to the embodiment of the present invention when being moved outwards.

Herein below, the technical means adopted by the present invention to achieve the aforesaid objective and efficacy will be detailed as follows with reference to preferred feasible embodiments and the attached drawings.

Referring to FIG. 1-4, an embodiment of the present invention mainly includes a grip 1, an adjusting member 2, a fixing member 3, and three movable members 4.

The grip 1 having an end provided with a pounding portion 10 and the other end provided with a protrusion 11, wherein a positioning annular groove 12 is formed around the protrusion 11, a threaded rod 13 is disposed in front of the protrusion 11, a washer 14 is disposed on the threaded rod 13, and the grip 1 is formed with anti-slip pattern 15 thereon and formed with two opposite planes 16.

The adjusting member 2 disposed on the protrusion 11 of the grip 1, wherein anti-slip pattern 20 is formed around circumference of the adjusting member 2, a connecting protrusion 21 is disposed on a side of the adjusting member 2, a perforation 22 extending to the other side is formed in the connecting protrusion 21, a positioning threaded hole 23 is formed in a wall surface of the connecting protrusion 21 to pass through the perforation 22, a positioning fastener 24 is screwed in the positioning threaded hole 23, and three corresponding grooves 25 in the form of an arc extending outwards from the center are bored on the outside of the perforation 22 on the other side of the adjusting member 2.

The fixing member 3 disposed on the adjusting member 2, wherein a positioning protrusion 30 is disposed on a side of the fixing member 3, a joint threaded hole 31 is formed in the positioning protrusion 30, an annular groove 32 is formed on an outer wall surface of the positioning protrusion 30, a washer 33 is disposed on the annular groove 32, three sliding grooves 34 are formed on the fixing member 3 trisectionally, and positioning guide grooves 35 opposite to each other are bored in both sides of each of the sliding grooves 34.

The three movable members 4 disposed on the fixing member 3 correspondingly, wherein a sliding block 40 is disposed on a side of each of the movable members 4, positioning guide blocks 41 opposite to each other are protruded at two side edges of the sliding block 40, the sliding block 40 is disposed in one of the sliding grooves 34 of the fixing member 3, the positioning guide blocks 41 are disposed in the positioning guide grooves 35 of the sliding groove 34, a guide protrusion 42 is disposed on surface of the sliding block 40, the guide protrusion 42 is disposed in one of the corresponding grooves 25 of the adjusting member 2, the movable member 4 is provided with a plurality of stepped abutting portions 43, and an external surface of each of the abutting portions 43 is bored with an abutting edge 44, thus finishing assembly of a bearing adjuster.

Referring to FIG. 1~4, while assembling, the sliding blocks 40 of the three movable members 4 are firstly disposed in the three sliding grooves 34 of the fixing member 3 respectively, and the positioning guide blocks 41 at the two sides of the sliding blocks 40 are disposed in the positioning guide grooves 35 of the fixing member 3 respectively. Thus, the three movable members 4 can move either inwards or outwards in the sliding grooves 34 of the fixing member 3. Then, the fixing member 3 is disposed on the side of the adjusting member 2 with the positioning protrusion 30 of the fixing member 3 being inserted into the perforation 22 of the adjusting member 2 and the guide protrusions 42 of the three movable members 4 being disposed in the three corresponding grooves 25 of the adjusting member 2 respectively. Then, the threaded rod 13 and the protrusion 11 of the grip 1 are inserted into the perforation 22 of the adjusting member 2, with the threaded rod 13 being screwed in the joint threaded hole 31 of the fixing member 3. Next, the positioning fastener 24 is screwed in the positioning threaded hole 23 of the adjusting member 2 so that the end portion of the positioning fastener 24 is disposed in the positioning annular groove 12 of the grip 1. Thus, the grip 1 is fixed on the adjusting member 2, and the fixing member 3 and the movable members 4 can be securely connected to the adjusting member 2. In this way, the assembly of the bearing adjuster can be completed.

Figure 7:
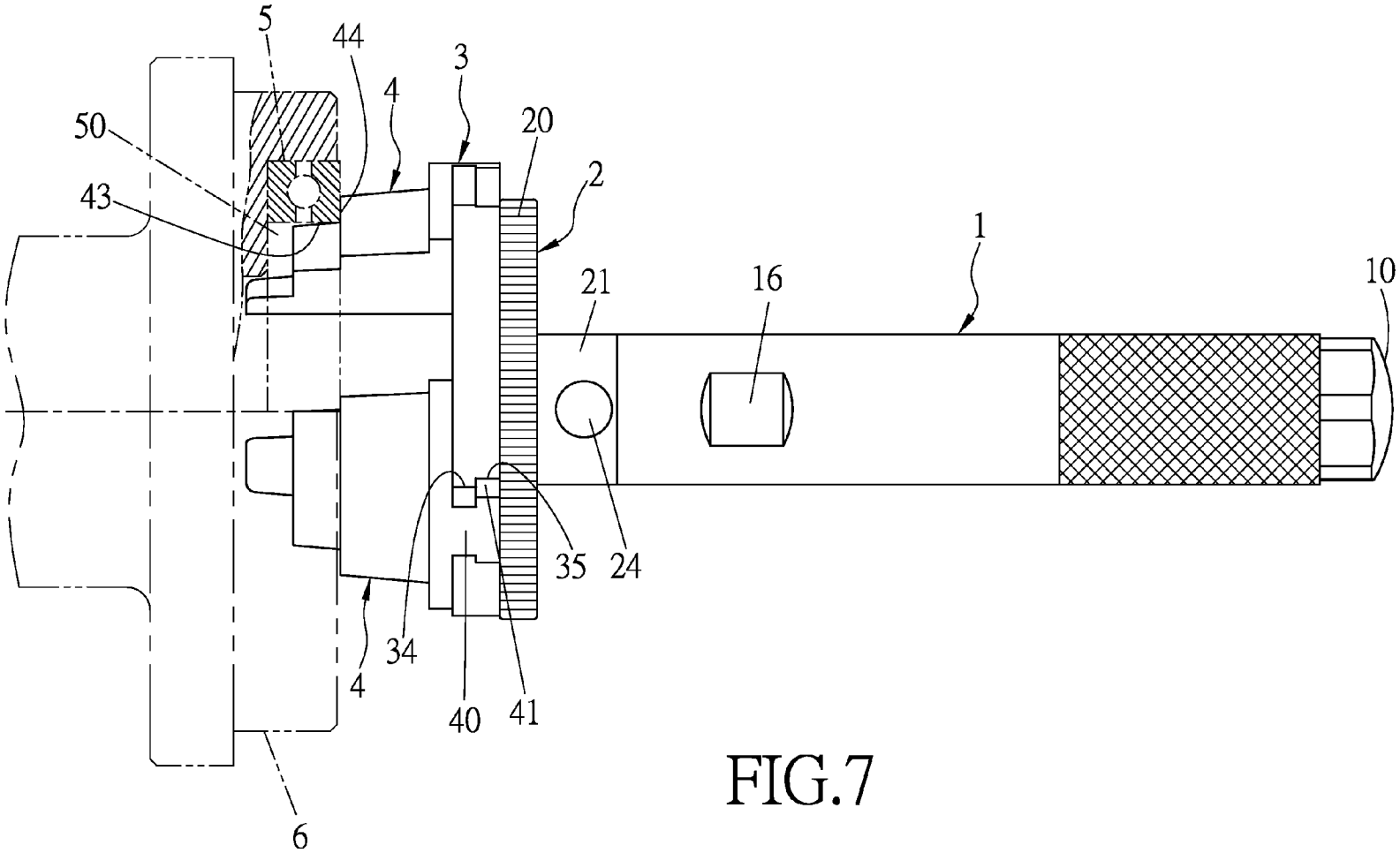
FIG. 7 is a schematic view illustrating use of the embodiment of the present invention when being disposed on a bearing.
Figure 8:
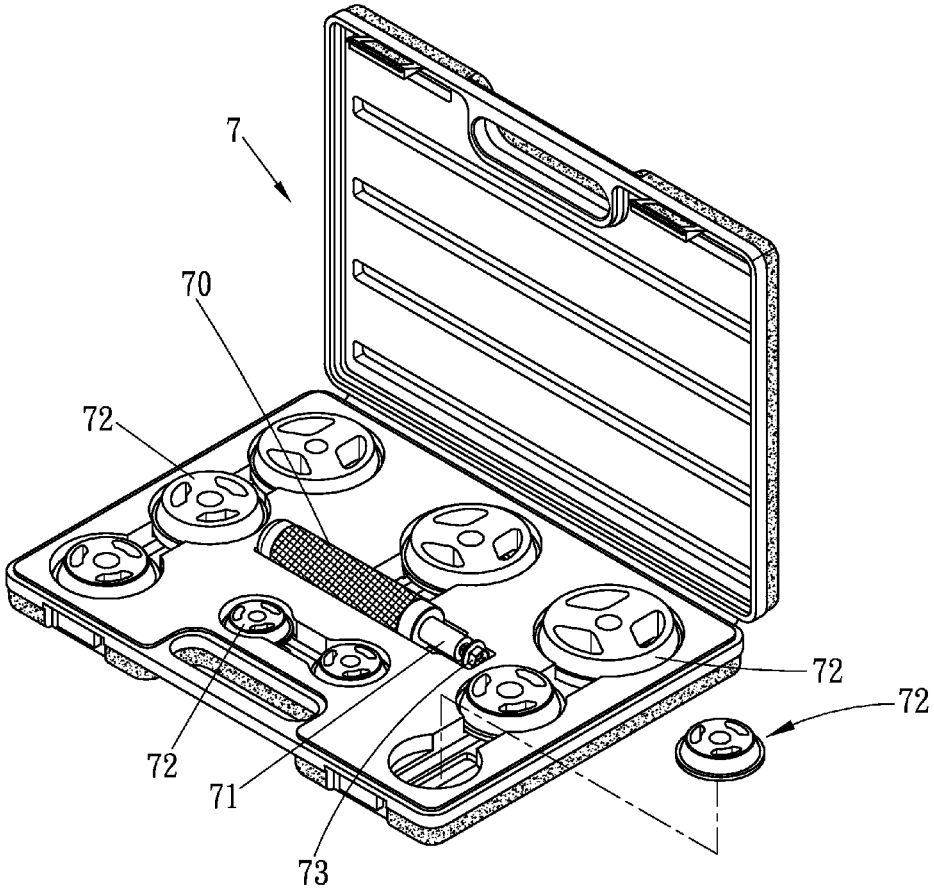
FIG. 8 is a perspective view of a prior art bearing adjuster set.
Figure 9:
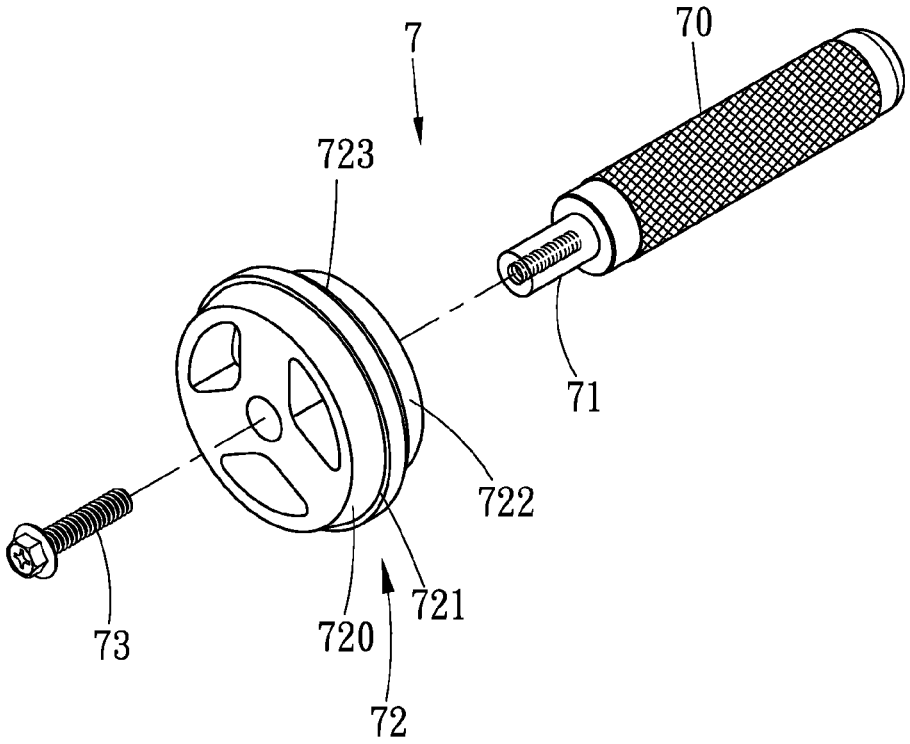
FIG. 9 is a perspective exploded view of the prior art bearing adjuster set.

Referring to FIG. 2~7, in order to install a bearing 5, the user only needs to converge the three movable members 4 inwardly to form a column in plurality steps firstly, then insert the movable members 4 into an axle hole 50 of the bearing 5 as shown in FIG. 7 and rotate the grip 1 in different direction from the rotating direction of the adjusting member 2. Then, the grip 1 drives the fixing member 3 and the movable members 4 to rotate together. The guide protrusions 42 of the three movable members 4 move along the three corresponding grooves 25 of the adjusting member 2 respectively. Thereby, the three movable members 4 move outwards until the abutting portions 43 of the movable members 4 abut against an inner wall surface of the axle hole 50 of the bearing 5 and the abutting edges 44 of the movable members 4 abut against a sidewall of the bearing 5. Therefore, when the pounding portion 10 of the grip 1 is pounded by a hammering tool, the pounding force can be consistently distributed to the body of the bearing so that the bearing 5 can be firmly disposed in an object 6 where the bearing 5 is assembled. By screwing the threaded rod 13 of the grip 1 and the joint threaded hole 31 of the fixing member 3 together, the present invention can reliably and securely assemble the components together without falling-off. Moreover, as compared to the prior art bearing adjuster not able to be rapidly replaced the positioning pressing block, the present invention can use a single tool to arbitrarily adjust its' diameter through the movable members 4 on the fixing member 3 according to the diameters of the axle hole 50 of the bearings 5. Hence, the bearing adjuster in the present invention is more stable and convenient in use.

According to the above descriptions, the present invention has indeed achieved the expected objective and efficacy, and is more ideal and practical than the prior art. However, what described above are only preferred embodiments of the present invention but are not intended to limit the scope of the present invention. Accordingly, any equivalent changes and modifications that are made without departing from the technologies disclosed in the present invention shall also fall within the scope of the present invention.

What is claimed is:

1. A bearing adjuster is comprised of:

a grip having an end provided with a pounding portion and the other end provided with a protrusion, wherein a positioning annular groove is formed around the protrusion, and a threaded rod is disposed at a front end of the protrusion;

an adjusting member disposed on the protrusion of the grip wherein a connecting protrusion is disposed on a side of the adjusting member, a perforation is formed in the connecting protrusion, a positioning threaded hole is formed in a wall surface of the connecting protrusion to pass through the perforation, a positioning fastener is screwed in the positioning threaded hole of the adjusting member, an internal end of the positioning fastener abuts within the positioning annular groove of the grip, and three corresponding three grooves, each groove having a form of an arc extending outwards from an outside of the perforation;

a fixing member disposed on the adjusting member, wherein a positioning protrusion is disposed on a side of the fixing member, a joint threaded hole is formed in the positioning protrusion, the threaded rod of the grip is screwed in the joint threaded hole of the positioning protrusion, an annular groove is formed on an outer wall surface of the positioning protrusion, a washer is disposed on the circular groove, three sliding grooves are bored on the fixing member and are spaced equally, and each sliding groove is formed with two positioning guide grooves which are positioned on two opposite wall of the sliding groove; and three movable members disposed on the fixing member correspondingly, wherein a side of each of the three movable members is formed with a respective sliding block, each sliding block is formed with two positioning guide blocks protruded at two side edges thereof, each of the sliding blocks is disposed in respective one of the sliding grooves of the fixing member, the positioning guide blocks are disposed in the positioning guide grooves of a respective one of the sliding groove, each sliding groove is formed with a respective guide protrusion, the guide protrusion is disposed in one of the corresponding grooves of the adjusting member, the movable member is provided with a plurality of stepped abutting portions, and an external surface of each of the abutting portions is bored with an abutting edge.

2. The bearing adjuster as claimed in claim 1, wherein a washer is disposed on the threaded rod of the grip, and the grip is formed with an anti-slip pattern thereon and formed with two opposite planes.

3. The bearing adjuster as claimed in claim 1, wherein an anti-slip pattern is provided around circumference of adjusting member.

* * * * *